United States Patent [19]

Goddard

[11] Patent Number: 4,476,688

[45] Date of Patent: Oct. 16, 1984

[54] REFRIGERANT RECOVERY AND PURIFICATION SYSTEM

[76] Inventor: Lawrence A. Goddard, P.O. Box 18822, Tampa, Fla. 33679

[21] Appl. No.: 454,424

[22] Filed: Feb. 18, 1983

[51] Int. Cl.[3] ..... F25B 49/00

[52] U.S. Cl. ..... 62/149; 62/292; 62/475; 62/513

[58] Field of Search ..... 62/85, 77, 149, 474, 62/475, 54, 513, 292

[56] References Cited

U.S. PATENT DOCUMENTS 3,150,495 9/1964 Reed ..... 62/54

3,232,070 2/1966 Sparano ..... 62/149

3,303,660 2/1967 Berg ..... 62/54

*Primary Examiner*—Ronald C. Capossela

[57] ABSTRACT

The present invention is directed to a self-contained refrigerant recovery and purification system capable of removing gaseous refrigerants from a disabled refrigeration unit for cleaning acid and impurities from the refrigerant so that the refrigerant can be reused or saved rather than being lost to the atmosphere or otherwise wasted. In addition to the feature of saving, cleaning and returning the refrigerant to the repaired refrigeration unit, the present invention can be used as a temporary condensing unit, or for clearing oil restrictions from lines in the refrigeration unit with a high-pressure build-up feature, or as a vacuum pump.

5 Claims, 2 Drawing Figures

REFRIGERANT RECOVERY AND PURIFICATION SYSTEM

FIELD OF INVENTION

This invention relates generally to a refrigerant recovery and purification system and more specifically to such a system capable of withdrawing refrigerant from a disabled or inoperative refrigeration unit, removing acid from the refrigerant, cleaning and reconditioning the refrigerant and returning it to the refrigeration unit when repaired.

BACK GROUND OF THE INVENTION

The repair of a disabled refrigeration system using a compressible refrigerant such as Freon suffers a significant drawback in that during the course of repair the refrigerant is usually discharged into the atmosphere and wasted. Efforts to overcome or substantially minimize the loss of refrigerant during repairs to the refrigeration system met with some success. For example, in U.S. Pat. No. 3,232,070, which issued on Feb. 1, 1966 an arrangement was provided wherein the refrigerant from a disabled system could be saved for future use. In this patented arrangement, the refrigerant was pumped from the disabled system, condensed and then stored in a storage tank. The patented arrangement also provided for the drying and the straining of the foreign materials from the condensed refrigerant prior to the storage thereof.

While prior art mechanisms such as exemplified by the arrangement in aforementioned patent provided for the saving of the refrigerant from disabled refrigeration systems, there were some attendant shortcomings which detracted from the desirability and effectiveness of the prior mechanisms. For example, in the arrangement in the aforementioned patent the refrigerant could be removed from the disabled system but no apparatus was provided for returning the refrigerant to the refrigeration system when repaired. Between the compressor of the previous arrangement and the disabled refrigeration unit no oil trap or filter device was provided to protect the compressor in the refrigerant saver from contaminated refrigerant taken from the disabled unit. Further, the condenser in the aforementioned patented arrangement had no facility for purging build-ups of air of which will eventually contaminate the refrigerants being removed. Also, the filtering system in the patented arrangement was designed to operate with relatively clean refrigerants and could not overcome the problems associated with acid in the refrigerant derived from burned out self-contained commercial compressing units. The prior arrangement had only one inlet to the receiving tank and was designed strictly for placing refrigerants in an external holding tank, since no internal storing capabilities were provided. The prior system could not provide for recirculating refrigerants through a disabled refrigeration unit.

SUMMARY OF THE INVENTION

It is an object of the present invention to provide a portable refrigerant recovery and purification system that will clean and save all refrigerant gases used in all refrigeration systems.

It is another object of the invention to provide a refrigerant recovery and purification system that will return the cleaned refrigerant gases to the repaired refrigeration unit.

It is yet another object of the invention to provide a refrigerant recovery and purification system that is designed to clean the acid from the refrigerant gases.

It is yet another object of the invention to provide a refrigerant recovery and purification system that is designed to be used as a temporary condensing unit.

It is yet another object of the invention to provide a refrigerant recovery and purification system designed to be used as a vacuum pump.

It is a further object of the invention to provide a refrigerant recovery and purification system capable of providing high pressure fluid for clearing oil restrictions from a disabled refrigeration unit.

It is still a further object of the invention to provide a self-contained refrigerant recovery and purification system with an improved condenser-evaporator arrangement wherein the fluid utilized in the evaporator is previously condensed refrigerant supplied from a reservoir in the self-contained system.

Other and further objects of the invention will be obvious upon an understanding of the illustrated embodiment about to be described or will be indicated in the appended claims, and various advantages not referred to herein will occur to one skilled in the art upon employment of the invention in practice.

DETAILED DESCRIPTION OF THE PRESENT INVENTION

Figure 1:
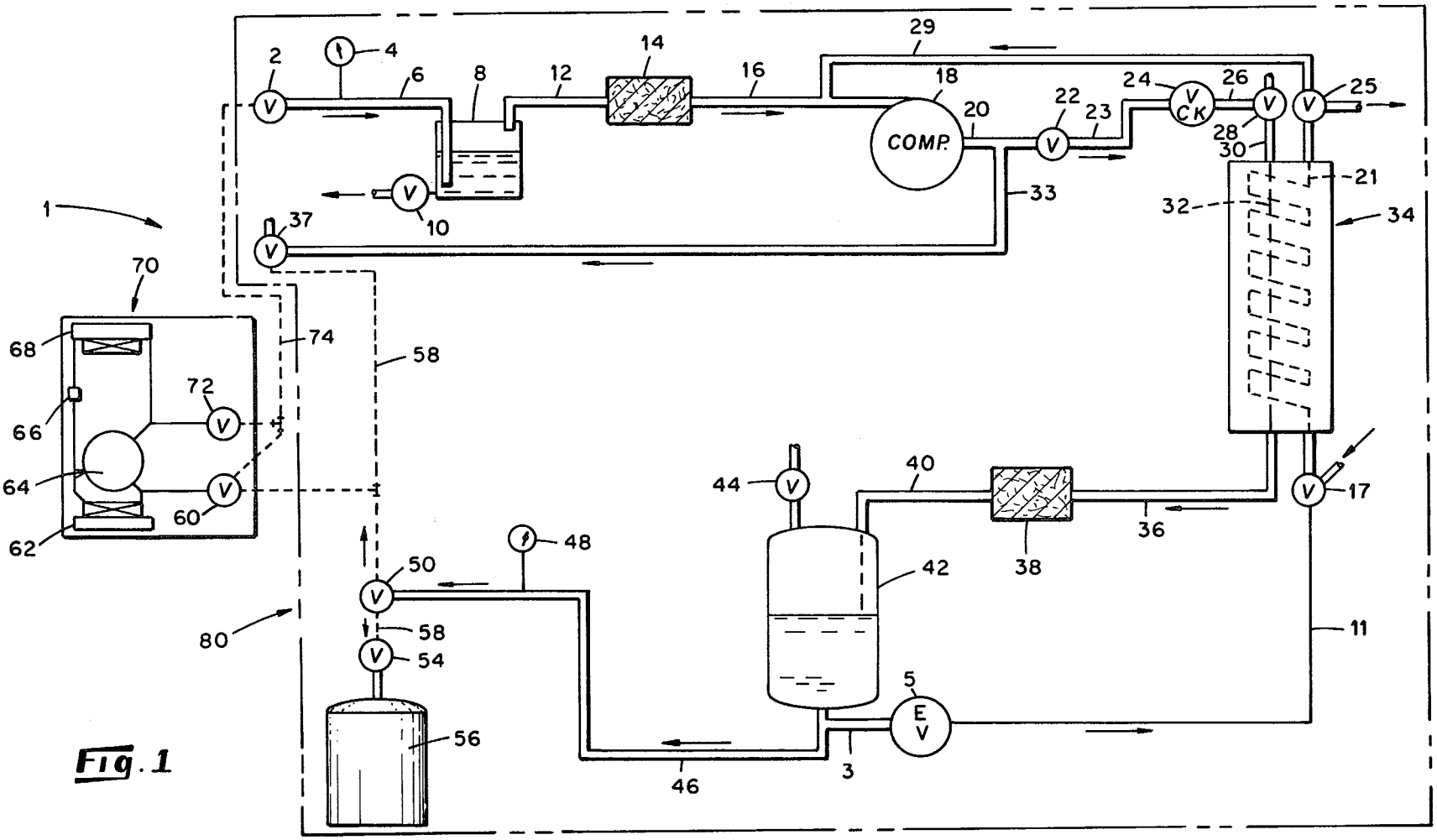
FIG. 1 is a view showing details of the refrigerant recovery and purification system of the present invention connected to a conventional refrigeration unit.

As illustrated schematically in FIG. 1 the refrigerant recovery and purification system 1 is connected to a disabled or nonfunctional refrigeration unit 70 by connecting a hose or conduit 74 to valves 72 and 60 of the refrigeration unit. The refrigeration unit 70 comprises of a three-way or double seated service valve 72 on the suction side of the compressor 64, a discharge service valve 60 on the outlet side of said compressor 64, a condensing unit 62 connected between the outlet side of the compressor 64, and an expansion apparatus 66. The gas leaving the expansion apparatus passes through an evaporator coil 68 into the compressor 64.

The refrigeration unit 70, is coupled to the system 1 of the present invention by a conduit 74 through valves 72, 60 and 2. The opening of valves 72, 60 and 2 provides for the withdrawing of gases from said refrigeration unit 70 to be processed by passing the gases via conduit 74 through conduit 6 containing a monitoring gauge 4 into the inlet of an oil trap 8 having a drain valve 10. The refrigerant gases are then drawn through the outlet in the oil trap 8 through conduits 12 and 16 to the compressor 18. An acid purification filter-drier 14 is disposed between conduits 12 and 16 for removing acid and other impurities such as acid, moisture, foreign particles and the like before the gases enter the compressor 18. The refrigerant is compressed in compressor 18 and discharged in a serial manner through conduit 20 containing a cut off valve 22, conduit 23 containing a check valve 24, conduit 26 containing a purge valve and high pressure switch 28. The compressed gases are then passed through conduit 30 into the condensing coil 32 of condenser-evaporator 34 where the hot compressed gas is converted to liquid. The valve and switch 28 provides access to the top of the condenser-evaporator 34 to bleed-off air from the latter when the air pressure in the condenser-evaporator 34 becomes excessive due to the presence of noncondensible air. Also, the valve and switch 28 is electrically or pneumatically coupled to the compressor 18 to effect the shut-down thereof if this air pressure build-up becomes critical.

Liquified refrigerant leaves the condensing coil 32 through conduit 36, through a liquid-line, acid-purification filter-drier 38 and into a receiving tank 42 by means of conduit 40. The refrigerant which is stripped of acid and other impurities in the filter-drier 38 is stored temporarily in tank 42. The receiving tank 42 is provided with a purge valve and high pressure switch 44 which provides for bleeding excess pressure from the tank 42. This valve and switch is also coupled electrically or pneumatically to the compressor 18 to effect the shut-down thereof in the event valve 28 fails.

Liquified gas is discharged from the receiving tank 42 through conduit 46 coupled to a high pressure monitoring gauge 48 and a control valve 50. The control valve 50 allows selective disbursement of clean liquified gas to an external holding tank 56 through conduit 58 having a control valve 54, or back into the refrigeration unit 70, when repaired, through conduit 58 and valve 60.

In accordance with the present invention a portion of liquified gas discharged from the receiving tank 42 enters a conduit 3 which is coupled to conduit 46. Conduit 3 conveys the liquified gas through an expansion apparatus 5 such as an expansion valve, venturi or any other suitable pressure-drop mechanism and then via conduit 11 through valve 17 into an evaporator coil 21 which is disposed in heat exchange relationship with the condenser coil 32. The liquified gas in coil 21 sufficiently cools the gas in the condenser coil 32 to effect the condensation thereof. The condensation of the gases in coil 32 sufficiently increases the temperature of the liquid in coil 21 to change it to a gaseous state. These gases are recycled through the compressor 18 via conduit 29 containing valve 25 which enables the opening or closing of coil 21 to the atmosphere. The valves 17 and 25 are double-seated so that, if desired, coolants such as alcohol, water or other fluids may be passed through the evaporator 21 to effect the condensation of the gases in the condenser coil 32. These externally supplied coolants would enter valve 17, pass through the coil 21 and exhaust through valve 25 to atmosphere or any other location.

A conduit 33 is connected to conduit 20 downstream of the compressor 18 for rerouting of gases from the compressor 18 to atmosphere through valve 37. This rerouting of gases through conduit 33 with valve 22 closed enables the compressor 18 to operate at zero head pressure thereby providing an evacuation arrangement for the disabled unit 70, or provide a high pressure build-up system, or function as a spare compressor with the compressed gases being returned to the refrigeration unit 70 through conduit 58.

Figure 2:
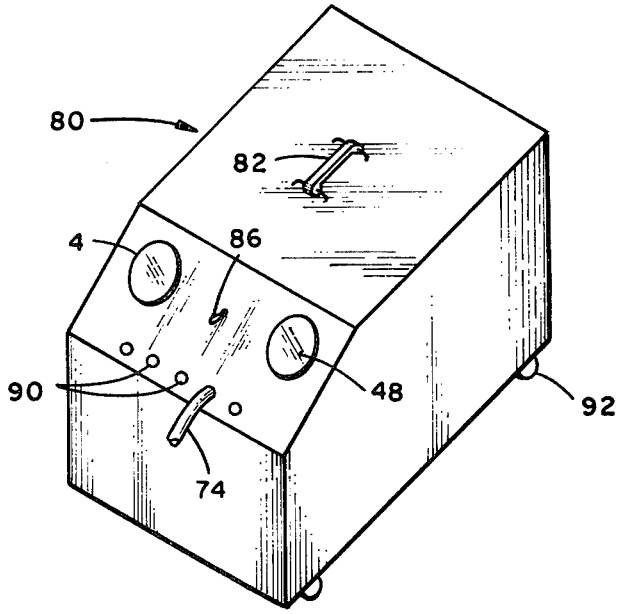
FIG. 2 is a view illustrating a metal or plastic housing for containing the system of the present invention as shown in FIG. 1.

As illustrated diagrammatically in FIG. 2 the housing 80 which can be metal or plastic is provided with a handle 82 for carrying purposes and rollers 92 for mobilization on flat surfaces. Pressure gauges 4 and 48 are provided for monitoring high and low pressures and other functions encountered during the operation of the present invention. One or more electrical switches 86 control the electrical functions while the ports 90 provide access for conduits or hoses such as 74 used to couple the system of the present invention to disabled refrigeration units.

In a typical operation, the refrigerant recovery and purification system 1 is coupled to a disabled refrigeration unit 70 by connecting conduit 74 to valves 72 and 60 of the refrigeration unit 70 and to valve 2 of the refrigerant recovery and purification system 1. Refrigerant is withdrawn from disabled refrigeration unit 70 by opening valves 2, 22, 28, 72 and 60 and closing valves 37, 10, 44, 5, 17, 25, 50 and 54. The operation of these valves may be manual, pneumatic or electrical solenoid-type valves. The withdrawn refrigerant flows through oil trap 8 where oil and impurities are separated from the refrigerant and held in oil trap 8 until removal through valve 10. The refrigerant is then passed through the suction-line acid-purification filter-drier 14 where acids, moisture, impurities, etc. are removed. This filter-drier 14 should be replaced every 3 to 6 months depending on frequency of use. The refrigerant is drawn from the filter-drier 14 into compressor 18 where the refrigerant is compressed and then pumped through valve 22, check valve 24, which provides for flow only away from compressor 18, and then through the high pressure switch and valve 28. The hot compressed gas is cooled and converted to a liquid state in the condenser coil 32 by passing in heat exchange relationship with the liquid refrigerant in evaporator 21 supplied to the evaporator coil 21 by opening valves 5, 17 and 25. The liquid refrigerant is then pumped through the liquid-line acid-purification filter-drier 38 wherein purification of the liquid refrigerant takes place. The liquid refrigerant is then passed into the receiving tank 42, where the liquid is held until returned to the refrigeration unit 70 through conduit 50 and valve 60 or discharged into an independent holding tank 56 through valve 54. The expansion valve 5 is opened to allow a minute amount of liquid refrigerant from tank 42 to pass through conduit 11 into the evaporator coil 21 of the condenser-evaporator 34 to provide sufficient evaporative expansion cooling to condense the hot gas in condenser coil 32. This gas from the evaporator 21 is then conveyed through conduit 29 to the compressor 18 to be reprocessed.

By backseating valves 17 and 25 the evaporator section 21 of the condenser 34 can be closed off from the recovery section of the refrigerant recovery and purification system 1 and opened to the atmosphere so that any liquid coolants such as water, alcohol and the like may be introduced into the evaporator to effect the condensation of the refrigerant in coil 32.

With the refrigerant recovery and purification system 1 connected to disabled refrigeration unit 70 as described above the latter may be evacuated on both sides of the compressor 64 by closing valves 22 and 50, opening valve 37 to atmosphere and connecting conduit 74 to valves 72 and 60. During this evacuation unwanted gases in unit 70 are drawn through valve 2, the oil trap 8, the acid-purification filter-drier 14 into the operating compressor 18, which then pumps the gases out conduit 33 and through valve 37 to atmosphere. This operation provides a vacuum pump arrangement which will not contaminate refrigerant that has been previously processed and still in the refrigerant recovery and purification system 1.

To engage the high pressure purge feature of the refrigerant recovery and purification system 1, the conduit 74 is disconnected from valves 60 and 72 and valve 2 is opened to atmosphere which allows atmospheric air to be drawn into the compressor 18 through the oil trap 8 and acid-purification filter-drier 14. The compressed air is pumped through conduit 33, valve 37, conduit 58 and back-seat valve 60 (which isolates compressor 64 from condenser 62) into the evaporator 68. This high pressure air purges the evaporator 68 and passes to atmosphere through valve 72.

To engage the temporary condensing feature of refrigerant recovery and purification system 1, conduit 74 is connected to valve 72 of disabled refrigeration unit 70 and valve 2 of refrigerant recovery and purification system 1. Valve 2 is then opened for allowing refrigerant to be drawn into the compressor 18 through the oil trap 8 and the filter-drier 14 to effect the compression thereof. By closing valve 22 the high pressure gas from the compressor 18 is passed through conduit 33 to valve 37, conduit 58 and through back-seat valve 60 which allows the high pressure gas to bypass the compressor 64 and flow into the condenser 62 where the gas is condensed into a liquid by condensation mechanism of the refrigeration unit 70. The resulting liquid flows from condenser 62 through the expansion valve 66 into evaporator 68 and where the liquid is converted into gas which is then drawn back into the recovery system 1, through valve 72, conduit 74 and valve 2 to repeat the process.

While the above description contains many specificities, these should not be construed as limitations on the scope of the invention, but rather as an exemplification of one preferred embodiment thereof. The scope of the invention should be determined not by the embodiment illustrated, but by the appended claims and their legal equivalents.

What is claimed is:

1. A refrigerant recovery and purification system for removing gaseous refrigerant from a disabled refrigeration unit, cleansing the refrigerant of contaminants, and converting the gaseous refrigerant to a liquid state for storage or subsequent return to the refrigeration unit upon repair thereof, said system comprising a compressor, first conduit means for coupling the compressor to a refrigerant line in the refrigeration unit, trap means in the first conduit means for removing oil and impurities from the gaseous refrigerant prior to reception thereof in the compressor, condensing means coupled to the compressor by second conduit means for receiving compressed refrigerant emanating from the compressor, evaporating means disposed in heat exchange relationship with said condensing means for effecting the conversion of the compressed refrigerant to a liquid state, third conduit means for conveying a gaseous fluid through said evaporating means with said fluid being at a temperature adequate for effecting said conversion with said third conduit means being coupled to said reservoir for receiving liquid refrigerant therefrom, expansion means disposed in said third conduit means for converting the liquid refrigerant therein to a gaseous state for providing the gaseous fluid conveyed through the evaporating means, reservoir means coupled to said condensing means by fourth conduit means for receiving the liquid refrigerant from the condensing means, filter and drying means disposed in said fourth conduit means for removing acid, moisture, foreign particles and the like, fifth conduit means coupled to said reservoir for conveying liquid refrigerant to a point of utilization, and sixth conduit means coupled to said evaporating means and said first conduit means for conveying the gaseous fluid from the evaporating means to the compressor.

2. The system claimed in claim 1, wherein the condensing means and the evaporating means are disposed in a common housing.

3. The system claimed in claim 1, wherein said first conduit means are coupled to an outlet of an evaporator in the refrigeration unit and said fifth conduit means are coupled to an inlet to a compressor in the refrigeration unit for bypassing the last mentioned compressor and thereby utilizing said system as a refrigerant condensing mechanism.

4. The system claimed in claim 1, wherein the first conduit means are coupled to an inlet and outlet of a compressor in the refrigeration unit when repaired, wherein valve means are disposed in said second conduit means for interrupting flow of fluid between the compressor and the condensing means in said system, and wherein seventh conduit means are coupled to said second conduit means at a location between the valve means and the compressor in said system, whereby the operation of the compressor in said system evacuates the refrigeration unit with the evacuated fluid being discharged to atmosphere through said seventh conduit means.

5. The system claimed in claim 1, wherein the fifth conduit means are coupled to an inlet to a compressor in the refrigeration unit when repaired for conveying liquid refrigerant from the reservoir means into the last mentioned compressor to effect the recharging of the refrigeration unit.

* * * * *